US007166152B2

(12) United States Patent
Okuhama et al.

(10) Patent No.: US 7,166,152 B2
(45) **Date of Patent: *Jan. 23, 2007**

(54) PRETREATMENT SOLUTION FOR PROVIDING CATALYST FOR ELECTROLESS PLATING, PRETREATMENT METHOD USING THE SOLUTION, AND ELECTROLESS PLATED FILM AND/OR PLATED OBJECT PRODUCED BY USE OF THE METHOD

(75) Inventors: Yoshiaki Okuhama, Akashi (JP); Keigo Obata, Akashi (JP); Masakazu Yoshimoto, Akashi (JP); Kim Dong Hyun, Akashi (JP); Shingo Kitamura, Akashi (JP); Seiichiro Nakao, Kobe (JP); Hidenori Tsuji, Fujisawa (JP); Hidemi Nawafune, Takatsuki (JP)

(73) Assignee: Daiwa Fine Chemicals Co., Ltd., Hyogo-ken (JP)

( * ) Notice: Subject to any disclaimer, the term of this patent is extended or adjusted under 35 U.S.C. 154(b) by 461 days.

This patent is subject to a terminal disclaimer.

(21) Appl. No.: 10/636,447

(22) Filed: Aug. 7, 2003

(65) Prior Publication Data

US 2004/0043153 A1 Mar. 4, 2004

(30) Foreign Application Priority Data

Aug. 23, 2002 (JP) ..... 2002-243430
Oct. 15, 2002 (JP) ..... 2002-300533
Nov. 11, 2002 (JP) ..... 2002-326687

(51) Int. Cl.
*C23C 18/28* (2006.01)

(52) U.S. Cl. ..... 106/1.11; 106/1.13; 106/1.19

(58) Field of Classification Search ..... 106/1.11, 106/1.19, 1.13
See application file for complete search history.

(56) References Cited

U.S. PATENT DOCUMENTS 3,011,920 A * 12/1961 Shipley, Jr. ..... 106/1.11
3,632,435 A * 1/1972 Eriksson et al. ..... 427/98.1
3,698,919 A * 10/1972 Kuzmik ..... 106/1.11
4,048,354 A 9/1977 Feldstein
4,131,699 A 12/1978 Feldstein
4,180,600 A 12/1979 Feldstein
6,743,319 B2 * 6/2004 Kydd ..... 156/230
6,902,765 B2 * 6/2005 Brandes et al. ..... 427/305
2005/0258134 A1 * 11/2005 Okuhama et al. ..... 216/13

FOREIGN PATENT DOCUMENTS

JP 63-54791 B2 10/1988
JP 06-006861 A 1/1994
JP 10-195667 A 7/1998
JP 10-229280 A 8/1998
JP 11-209878 A 8/1999
JP 11-241170 A 9/1999
JP 2000-082878 A 3/2000
JP 2001-032092 A 2/2001
JP 2001-167647 A 6/2001
JP 2001-325831 A 11/2001

OTHER PUBLICATIONS

English translation of JP2001/032092; Feb. 2001.*
English translation of JP 11/241170; Sep. 1999.*
Masao Iwai et al., "Activation of Plastic with Mixed-Colloid Solutions in the Electroless Plating of Copper", *The Journal of the metal Finishing Society of Japan*, vol. 38, No. 6, pp. 26-27 & 56, (1987), no month available.
Proceedings of the 15th JIEP Annual Meeting, pp. 25 & 26, (2001), no month available.
Summary of the 103th SFSJ Meeting, pp. 150-151 & 372 (2001), no month available.
Summary of the 68th ECSJ Meeting, ISO7, pp. 410 (2001), no month available.
Yutaka Fujiwara et al., "Electrodeposition of Sn-Ag Alloys from Pyrophosphate Baths Containing Suspended Ag Nanoparticles", vol. 50, No. 12, pp. 147-148, (1999), no month available.

* cited by examiner

*Primary Examiner*—Helene Klemanski
(74) *Attorney, Agent, or Firm*—Akin Gump Strauss Hauer & Feld, LLP

(57) ABSTRACT

A pretreatment solution for providing a catalyst for electroless plating and a pretreatment method using the solution are provided. The pretreatment solution comprises a silver colloidal solution containing, as essential components, at least the following components (I), (II) and (III): (I) silver colloidal particles, (II) one or more ions selected from an ion of a metal having an electric potential which can reduce a silver ion to metal silver in the solution and an ion oxidized at the time of reduction of the silver ion, and (III) one or more ions selected from a hydroxycarboxylate ion, a condensed phosphate ion and an amine carboxylate ion, the silver colloidal particles (I) being produced by the ion of the metal (II) having an electric potential which can reduce a silver ion to metal silver. When an object to be plated is pretreated by use of the pretreatment solution, provision of an effective catalyst for electroless plating is achieved.

27 Claims, No Drawings

PRETREATMENT SOLUTION FOR PROVIDING CATALYST FOR ELECTROLESS PLATING, PRETREATMENT METHOD USING THE SOLUTION, AND ELECTROLESS PLATED FILM AND/OR PLATED OBJECT PRODUCED BY USE OF THE METHOD

BACKGROUND OF THE INVENTION (i) Field of the Invention

The present invention relates to a plating technique, particularly to a technique of providing a catalyst for electroless plating.

(ii) Description of the Related Art

Heretofore, to provide a catalyst as a pretreatment for giving electroless plating on a non-metal or a metal having no (or little) catalytic activity, there has been employed in most cases a method which comprises the steps of giving sensitivity by use of a tin-containing solution and then giving catalytic activity by use of a palladium-containing solution. In addition, a method of treating an object by use of one solution containing both palladium and tin has also been widely used. In any case, it can be said that substantially only palladium is a metal which is industrially used as a catalyst for electroless plating.

Such a method of providing a catalyst by palladium and tin has such problems as described below.

(1) A production cost increases as a result of an increase in the price of palladium.

(2) In a production process of, for example, a printed board, palladium adsorbed on the surface of a resin in providing a catalyst for electroless copper plating remains as a smut even after etching of a copper plated film, and subsequent electroless nickel plating is inconveniently deposited not only on a circuit pattern portion but also on the resin.

It has already been researched to replace palladium with another inexpensive metal. Roughly, (1) a method using a colloidal solution of a metal such as silver, copper or nickel and (2) a method using a colloidal solution of a hydroxide or oxide of a metal such as nickel or copper have already been reported or applied for a patent and disclosed.

More specifically, as the above method (1) using a metal colloidal solution, the following methods are disclosed. Japanese Patent Application Laid-Open No. 6861/1994 discloses a silver colloidal solution having excellent storage stability and a preparation method thereof. Japanese Patent Application Laid-Open No. 195667/1998 discloses a catalyst solution containing at least one of palladium, platinum, gold, silver and copper salts, an inorganic acid and a water-soluble unsaturated organic compound. Japanese Patent Application Laid-Open No. 209878/1999 discloses use of a tertiary amine polymer or quaternary ammonium polymer as a colloid stabilizer in preparing a colloidal solution by reducing ruthenium, rhodium, nickel, palladium, platinum, silver and gold with a boron hydride compound, an amine borane compound, formalin, hydrazine and a hypophosphite. Japanese Patent Application Laid-Open No. 241170/1999 discloses a solution containing an iron, nickel or cobalt compound as well as a silver salt, an anion compound and a reducing agent. Japanese Patent Application Laid-Open No. 167647/2001 discloses use of a hydroxy acid salt having at least three —COOH and —OH groups in total, the number of —COOH groups being equal to or larger than the number of —OH groups, particularly use of a citrate, as a dispersant. Japanese Patent Application Laid-Open No. 32092/2001 discloses use of a noble metal salt of methanesulfonic acid as a noble metal colloid.

Such patents may contain descriptions about copper, nickel and other metals as metal components forming a colloid. However, from the viewpoint of practical performance, a metal colloid which may possibly be industrialized is limited to a silver colloid.

Meanwhile, as the above method (2) using a hydroxide colloidal solution, the following methods are disclosed.

Heretofore, Iwai et al. have reported the results of carrying out electroless copper plating by immersing objects to be plated in hydroxide colloidal solutions prepared by addition of alkali to solutions of $NiSO_4$, $NiCl_2$, $CuSO_4$ and $CuCl_2$ and then immersing the immersed objects in a $KBH_4$ solution so as to reduce the colloids and provide catalytic activity, with reference to U.S. patents (U.S. Pat. Nos. 4,048,354, 4,131,699 and 4,180,600) (Masao Iwai, Hiroshi Majima, Yasuhiro Awakura, The Journal of the Metal Finishing Society of Japan, Vol. 38, No. 6, 1987). In this report, they have also studied colloids of lead, cobalt, cadmium, zinc, manganese and aluminium in addition to nickel and copper. In recent years, new attempts made based on the studies have been reported. Japanese Patent Application Laid-Open No. 209878/1999 discloses a method of stabilizing a metal hydroxide colloid. The publication introduces, as a preferred reducing agent for reducing the colloid, a mixture of one or more components selected from the group consisting of a boron hydride compound, an amine borane compound, formalin, hydrazine and a hypophosphite. Japanese Patent Application Laid-Open No. 82878/2000 discloses use of the above method for production of a buildup multilayer printed wiring board and introduces potassium borohydride as an example of a reducing agent. Tsuru et al. have reported a study to improve adhesion by reducing a metal hydroxide colloid adsorbed to the surface of an object to be plated in the same manner as described above by use of a sodium borohydride solution and then reducing the resulting colloid by use of a hypophosphorous acid solution (Yutaka Tsuru, Michiyuki Kume, Yashichi Oyagi, Proceedings of the 15$^{th}$ JIEP Annual Meeting, page 25, 2001). Further, Tsuru et al. have also reported that when carbon and zinc are deposited by vacuum deposition after adsorption of the metal hydroxide colloid and the resulting colloid is immersed in acid, the colloid is reduced at the time of dissolution of zinc, whereby a catalyst for electroless plating can be provided (Yutaka Tsuru, Rie Odajima, Michiyuki Kume, Yashichi Oyagi, Summary of the 103$^{th}$ SFSJ Meeting, page 150, 2001). Yanagimoto et al. have obtained a thin copper film by coating a solution having superfine copper oxide particles dispersed in ethanol on an AlN board by spin coating, firing the coated board at 600 to 1,000° C., reducing the copper oxide in a hydrogen atmosphere and then carrying out electroless copper plating (Hiroshi Yanagimoto, Kensuke Akamatsu, Naruhito Ideki, Kazuo Goto, Summary of the 68$^{th}$ ECSJ Meeting, page 410, 1S07, 2001).

Despite these many studies, methods using metals other than palladium are not yet used industrially because they provide lower catalytic activity than the method using palladium and a method for preparing a stable solution is not yet established.

Patent Document 1

Japanese Patent Application Laid-Open No. 6861/1994

Patent Document 2

Japanese Patent Application Laid-Open No. 195667/1998

Patent Document 3

Japanese Patent Application Laid-Open No. 209878/1999

Patent Document 4

Japanese Patent Application Laid-Open No. 241170/1999

Patent Document 5

Japanese Patent Application Laid-Open No. 167647/2001

Patent Document 6

Japanese Patent Application Laid-Open No. 32092/2001

Patent Document 7

U.S. Pat. No. 4,048,354

Patent Document 8

U.S. Pat. No. 4,131,699

Patent Document 9

U.S. Pat. No. 4,180,600

Patent Document 10

Japanese Patent Application Laid-Open No. 82878/2000

Non-Patent Document 1

Masao Iwai, Hiroshi Majima, Yasuhiro Awakura, The Journal of the Metal Finishing Society of Japan, Vol. 38, No. 6, 1987

Non-Patent Document 2

Yutaka Tsuru, Michiyuki Kume, Yashichi Oyagi, Proceedings of the 15$^{th}$ JIEP Annual Meeting, 2001, page 25

Non-Patent Document 3

Yutaka Tsuru, Rie Odajima, Michiyuki Kume, Yashichi Oyagi, Summary of the 103$^{th}$ SFSJ Meeting, 2001, page 150

Non-Patent Document 4

Hiroshi Yanagimoto, Kensuke Akamatsu, Naruhito Ideki, Kazuo Goto, Summary of the 68$^{th}$ ECSJ Meeting, 1S07, 2001, page 410

SUMMARY OF THE INVENTION

The present inventors have determined that an object of the present invention is to develop a solution and method for providing a catalyst for electroless plating which has satisfactory catalysis and adhesion as a substitution for palladium by use of an inexpensive silver colloid.

The present inventors have made further studies based on the fact that a silver colloid produced by reducing a silver ion by an ion of a metal having an electric potential which can reduce a silver ion to metal silver in a solution is stable and based on the idea that when a solution of ions of metals having an electric potential which can reduce silver ions to metal silver in the solution is mixed with a solution of a silver compound so as to produce a silver colloid, the metal ions should be stabilized by a complexing agent in advance. As a result, they have found that when a solution containing silver ions is added to and mixed into a solution containing, as essential components, (II) an ion of a metal having an electric potential which can reduce a silver ion to metal silver in the solution and (III) one or more ions selected from a hydroxycarboxylate ion, a condensed phosphate ion and an amine carboxylate ion, a fine colloid is produced, the silver colloid exists in a very stable condition, the solution provides an electroless plated film having excellent catalysis and good adhesion. Further, the present inventors have also found that incorporation of an ion of a metal selected from metals of atomic numbers 26 to 30 causes the silver colloid solution to be further stable and have higher catalytic activity. By use of the solution, an industrially usable method for providing a catalyst for electroless plating has been completed.

Therefore, the present invention relates to a pretreatment solution for providing a catalyst for electroless plating, comprising a silver colloidal solution containing, as essential components, at least the following components (I), (II) and (III):

(I) silver colloidal particles, (II) one or more ions selected from an ion of a metal having an electric potential which can reduce a silver ion to metal silver in the solution and an ion oxidized at the time of reduction of the silver ion, and (III) one or more ions selected from a hydroxycarboxylate ion, a condensed phosphate ion and an amine carboxylate ion, the silver colloidal particles (I) being produced by the ion of the metal (II) having an electric potential which can reduce a silver ion to metal silver.

Further, the present invention relates to the above pretreatment solution for providing a catalyst for electroless plating, wherein the above silver colloidal solution further contains (IV) one or more ions selected from ions of metals of atomic numbers 26 to 30.

Further, the present invention is a pretreatment method for providing a catalyst for electroless plating which comprises subjecting an object to be plated to known pretreatments such as degreasing, etching and conditioning, and immersing the object to be plated in the silver colloidal solution or coating the solution on the object to be plated so as to adsorb a silver colloid to be used as a catalyst nucleus for electroless plating on the surface of the object to be plated.

Further, in the method of the present invention for providing a catalyst, it is possible to provide catalytic activity only by immersing the object to be plated in the colloidal solution or coating the solution on the object to be plated. However, it is also possible to add another step of further immersing the object to be plated in an acid solution or a solution containing a reducing agent after adsorption of the colloid so as to improve the catalytic activity. Electroless plating is carried out after these steps.

Further, a drying step may be further carried out after the immersion or drying step or after the step of immersing the object to be plated in the solution containing a reducing agent or the acid solution or coating the solution on the object to be plated.

Hereinafter, embodiments of the present invention will be described in detail.

DETAILED DESCRIPTION OF THE PREFERRED EMBODIMENTS

As the silver colloidal solution, a solution prepared by mixing a solution having a silver compound dissolved therein with the above solution in which (II) one or more ions of metals having an electric potential which can reduce a silver ion to metal silver in the solution and (III) one or more ions selected from a hydroxycarboxylate ion, a condensed phosphate ion and an amine carboxylate ion are dissolved is used.

Alternatively, it is also possible to use a preparation method in which after the solution having a silver compound dissolved therein is mixed with the solution in which (II) one or more ions of metals having an electric potential which can reduce a silver ion to metal silver in the solution and (III) one or more ions selected from a hydroxycarboxylate ion, a condensed phosphate ion and an amine carboxylate ion are dissolved, (III) one or more ions selected from a hydroxycarboxylate ion, a condensed phosphate ion and an amine carboxylate ion are further added to the resulting solution.

Therefore, to prepare the silver colloidal solution of the present invention, ions of metals having an electric potential which can reduce silver ions to metal silver in the solution and silver ions are essential, and ions of metals, described later, of atomic numbers 26 to 30 may be contained. In addition, the thus prepared silver colloidal solution also contains oxidized ions of metals having an electric potential which can reduce silver ions to metal silver in the solution at the time of reduction of the silver ions. To keep these metal ions in the solution stably, (III) one or more ions selected from a hydroxycarboxylate ion, a condensed phosphate ion and an amine carboxylate ion are contained. Accordingly, these complexing agents are also essential components.

Of the above hydroxycarboxylate ion, condensed phosphate ion and amine carboxylate ion (III), as the hydroxycarboxylic acid, glycolic acid, lactic acid, glyceric acid, malic acid, tartaric acid, citric acid or gluconic acid is suitably used. Of these, tartaric acid, citric acid or gluconic acid is more suitably used, and citric acid or gluconic acid is most suitably used. It can be added as a salt of sodium, potassium or the like or as acid.

As the condensed phosphoric acid, a linear polyphosphoric acid or cyclic metaphosphoric acid can be used. Of these, pyrophosphoric acid or triphosphoric acid is suitably used as the linear polyphosphoric acid, and pyrophosphoric acid is particularly suitably used. The condensed phosphoric acid may be used as a salt with sodium, potassium or the like.

As the amine carboxylic acid, an amine carboxylic acid selected from glycine, alanine, valine, leucine, isoleucine, lysine, serine, threonine, phenylalanine, aspartic acid, glutamic acid, ethylenediaminetetraacetic acid, iminodiacetic acid, nitrilotriacetic acid, diethylenetriaminepentaacetic acid, triethylenetetraminehexaacetic acid, ethylenedioxybis (ethylamine)-N,N,N',N'-tetraacetic acid, glycol ethylenediaminetetraacetic acid, N-hydroxyethylethylenediaminetetraacetic acid and salts thereof is suitably used. It can be added in the form of acid or a salt.

Of these complexing agents, citric acid, tartaric acid, gluconic acid and pyrophosphoric acid are more suitably used, and gluconic acid, citric acid and pyrophosphoric acid are particularly suitably used.

The hydroxycarboxylate ion, condensed phosphate ion and/or amine carboxylate ion are/is used so as to cause tin, iron or titanium ions which reduce silver ions to metal silver and/or ions selected from ions of metals of atomic numbers 26 to 30 and contained for further stabilization to exist in the solution stably. The contents of these complexing agents are preferably changed according to the content of the metal ions. The complexing agent is desirably used in an amount at least equivalent to the metal ions. A suitable content thereof is preferably 1.05 to 30 times larger than that of the metal ions in terms of equivalent weight. More suitably, a content of 1.3 to 10 times larger than that of the metal ions is used.

The silver colloid in the pretreatment solution (catalyst solution) of the present invention is produced by reducing silver ions with ions of metals (II) having an electric potential which can reduce the silver ions to metal silver in the solution. As a source for the silver ions, a salt of an inorganic acid such as silver nitrate, silver perchlorate or silver sulfite, a salt of an organic acid such as silver acetate or silver citrate as well as silver organic sulfonate to be described later are suitably used. Of these, silver nitrate and silver organic sulfonate are more suitably used, and silver organic sulfonate is most suitably used.

As the content of the silver ions at the time of preparation of the silver colloidal solution, 0.005 to 100 g/L is suitably used, 0.01 to 50 g/L is more suitably used, and 0.05 to 20 g/L is most suitably used.

As the ions of metals (II) which reduce silver ions to metal silver in the solution, divalent tin, divalent iron or/and trivalent titanium is/are suitably used. Of these, divalent tin is more suitably used. Some or all of these ions may be contained in the silver colloidal solution in the form of ions oxidized at the time of reducing the silver ions.

To prepare an aqueous solution of the metal ions which reduce silver ions to metal silver in the solution, known compounds of these metals, generally, salts or complexes thereof are used. That is, a salt or complex with an inorganic acid such as sulfuric acid, hydrochloric acid, nitric acid, fluoroboric acid, fluorosilicic acid, phosphoric acid or sulfamic acid and an organic sulfonic acid or carboxylic acid to be described later is used.

As the content of the metal ions which reduce silver ions to metal silver in the solution, i.e., tin, iron or titanium ions, at the time of preparation of the silver colloidal solution, 0.1 to 200 g/L is suitably used, 1 to 100 g/L is more suitably used, and 1 to 50 g/L is most suitably used.

Further, the silver colloidal solution can further contain (IV) one or more ions selected from ions of metals of atomic numbers 26 to 30. More specifically, these metals are iron, cobalt, nickel, copper and zinc presented in the order of atomic numbers thereof. Iron is suitably used when tin or titanium is used as the ions of metals (II) having an electric potential which can reduce silver ions to metal silver in the solution. These metal ions may be contained in a solution of the ions of metals (II) having an electric potential which can reduce silver ions to metal silver in the solution at the preparation of the silver colloid or added and contained after preparation of the silver colloid.

As the content of these metal ions, 0.1 to 200 g/L is suitably used, 1 to 100 g/L is more suitably used, and 1 to 50 g/L is most suitably used.

Addition of these metal ions appears particularly effective in improving catalytic activity when a method to be described later comprising the steps of immersing an object to be plated in a colloidal solution and then immersing the object to be plated in a solution containing a reducing agent is employed. It is not essential but preferable that compounds thereof be contained in a solution containing a compound of a metal having an electric potential which can reduce silver ions to metal silver in the solution before the metal compound solution is mixed with a solution containing a silver compound.

As sources for the these metal ions, known compounds of these metals, generally, salts or complexes thereof are used. That is, a salt or complex with an inorganic acid such as sulfuric acid, hydrochloric acid, nitric acid, fluoroboric acid, fluorosilicic acid, phosphoric acid or sulfamic acid and an organic sulfonic acid or carboxylic acid to be described later is used.

Thus, the acid ions or complexing agents of these metal salts exist in the solution when the metal having an electric potential which can reduce silver ions to metal silver in the solution and the silver compound are dissolved. In addition, further stabilization of the solution can be achieved by containing it as so-called free acids or complexing agents in amounts at least equivalent to that of tin or silver ions. Further, these acids can be used for adjusting pH.

As the organic sulfonic acid used as the acid radical of the above metal salt or for adjustment of pH or the like, there can be suitably used an aliphatic sulfonic acid represented by the following general formula (A):

$$(X_1)_n—R_1—SO_3H$$

wherein $R_1$ represents an alkyl group having 1 to 5 carbon atoms, an alkenyl group having 2 to 5 carbon atoms or an alkynyl group having 2 to 5 carbon atoms; $X_1$ represents hydrogen, a hydroxyl group, an alkyl group having 1 to 5 carbon atoms, an alkoxy group having 1 to 5 carbon atoms, an aryl group, an aralkyl group, a carboxyl group or a sulfonic group and may be present at any position of $R_1$; and n is an integer of 0 to 3, or the following general formula (B):

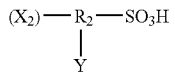

wherein $R_2$ represents an alkyl group having 1 to 5 carbon atoms or an alkylene group having 1 to 3 carbon atoms, the alkylene group may have a hydroxyl group at any position; $X_2$ represents halogen, i.e., chlorine or/and fluorine, chlorine or/and fluorine may substitute for one to all hydrogen atoms coordinated to the alkyl or alkylene group, and chlorine or fluorine as a substituent may be present at any position; Y represents hydrogen or a sulfonic group, and the number of substitutions of the sulfonic group represented by Y is 0 to 2, and an aromatic sulfonic acid represented by the following general formula (C):

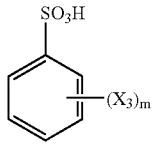

wherein $X_3$ represents a hydroxyl group, an alkyl group having 1 to 5 carbon atoms, an alkoxy group having 1 to 5 carbon atoms, an aryl group, an aralkyl group, an aldehyde group, a carboxyl group, a nitro group, a mercapto group, a sulfonic group or an amino group, and together with a benzene ring, two $X_3$s can form a naphthalene ring; and m is an integer of 0 to 3.

As the above sulfonic acid, methanesulfonic acid, methanedisulfonic acid, methanetrisulfonic acid, trifluoromethanesulfonic acid, ethanesulfonic acid, propanesulfonic acid, 2-propanesulfonic acid, butanesulfonic acid, 2-butanesulfonic acid, pentanesulfonic acid, hexanesulfonic acid, decanesulfonic acid, dodecanesulfonic acid, 2-hydroxyethane-1-sulfonic acid, 1-hydroxypropane-2-sulfonic acid, 3-hydroxypropane-1-sulfonic acid, 2-hydroxypropane-1-sulfonic acid, 2-hydroxybutanesulfonic acid, 2-hydroxypentanesulfonic acid, 2-hydroxyhexane-1-sulfonic acid, 2-hydroxydecanesulfonic acid, 2-hydroxydodecanesulfonic acid, 1-carboxyethanesulfonic acid, 2-carboxyethanesulfonic acid, 1,3-propanedisulfonic acid, allylsulfonic acid, 2-sulfoacetic acid, 2- or 3-sulfopropionic acid, sulfosuccinic acid, sulfomaleic acid, sulfofumaric acid, monochloromethanesulfonic acid, perchloroethanesulfonic acid, trichlorodifluoropropanesulfonic acid, perfluoroethanesulfonic acid, monochlorodifluoromethanesulfonic acid, trifluoromethanesulfonic acid, trifluoroethanesulfonic acid, tetrachloropropanesulfonic acid, trichlorodifluoroethanesulfonic acid, monochloroethanolsulfonic acid, dichloropropanolsulfonic acid, monochlorodifluorohydroxypropanesulfonic acid, benzenesulfonic acid, toluenesulfonic acid, xylenesulfonic acid, nitrobenzenesulfonic acid, sulfobenzoic acid, sulfosalicylic acid, benzaldehydesulfonic acid, p-phenolsulfonic acid, phenol-2,4-disulfonic acid, 2-sulfoacetic acid, 2-sulfopropionic acid, 3-sulfopropionic acid, sulfosuccinic acid, sulfomethylsuccinic acid, sulfofumaric acid, sulfomaleic acid, 2-sulfobenzoic acid, 3-sulfobenzoic acid, 4-sulfobenzoic acid, 5-sulfosalicylic acid, 4-sulfophthalic acid, 5-sulfoisophthalic acid, 2-sulfoterephthalic acid and the like are suitably used.

Of these, methanesulfonic acid, 2-hydroxyethane-1-sulfonic acid, 2-hydroxypropane-1-sulfonic acid, phenolsulfonic acid, cresolsulfonic acid, trifluoromethanesulfonic acid, naphthalenesulfonic acid and the like are more suitably used, and methanesulfonic acid and 2-hydroxyethane-1-sulfonic acid are particularly suitably used.

The silver colloidal solution used in the pretreatment for providing a catalyst in the present invention can be generally prepared by mixing a solution containing the ions of metals (II) which reduce silver ions to metal silver in the solution and, as required, a solution containing ions (IV) selected from ions of metals of atomic numbers 26 to 30 with a solution containing monovalent silver under agitation. Further, tetravalent tin ions or tin compound can also be contained so as to further increase catalytic activity. Illustrative examples of such a compound include a hydride, a stannate, a halide and an organotin compound. Further, the tetravalent tin ions or tin compound can be produced in the solution in a non-excessive amount by bubbling air or an oxygen-containing gas before or after mixing of a solution containing divalent tin with a solution containing silver ions.

The content of the tetravalent tin ions or tin compound is not particularly limited. However, catalytic activity can be further increased particularly when the content is at least 5% of the ions of metals having an electric potential which can reduce silver ions to metal silver in the solution. Further, the stability of the solution is also improved.

Further, the silver colloidal solution according to the present invention may further contain one or more saturated aliphatic alcohols which have 10 carbon atoms or less and only a hydroxyl group as a substituent, selected from a linear saturated aliphatic mono-, di- or tri-alcohol represented by the following general formula (1):

$$C_nH_{2n+2-m}(X)_m$$

wherein n is an integer which is larger than m but not larger than 10; m represents an integer of 1 to 6; Xs each are hydrogen or a hydroxyl group and may be the same or different, at least one of Xs is a hydroxyl group, and Xs may be bonded to any positions of any carbon atoms; and the carbon chain may be branched, a cyclic saturated aliphatic mono-, di- or tri-alcohol represented by the following general formula (2):

$$C_nH_{2n+2-m}(X)_m$$

wherein n is an integer which is larger than m but not larger than 10; m represents an integer of 1 to 6; Xs each are hydrogen or a hydroxyl group and may be the same or different, at least one of Xs is a hydroxyl group, and Xs may be bonded to any positions of any carbon atoms; and the carbon chain may be branched, and a linear saturated aliphatic mono-, di- or tri-alcohol having an ether linkage represented by the following general formula (3):

$$C_nH_{2n+2-m}O_l(X)_m$$

wherein n is an integer which is larger than m but not larger than 10; m represents an integer of 1 to 4; l represents an integer of not larger than n−2; Xs each are hydrogen or a hydroxyl group and may be the same or different, at least one of Xs is a hydroxyl group, and Xs may be bonded to any positions of any carbon atoms; the carbon chain may be branched; and O represents ether oxygen and is present between any two carbon atoms.

More specifically, as the alcohol represented by the general formula (1), methanol, ethanol, n-propanol, i-propanol, n-butanol, i-butanol, t-butanol, 1-pentanol, 2-pentanol, 3-pentanol, 1,6-hexanediol, 2,5-hexanediol, 1,2-ethanediol (ethylene glycol), 1,2-propanediol (propylene glycol), 1,3-propanediol (trimethylene glycol), 1,2,3-propanetriol (glycerol), sorbitol and the like are suitably used. Of these, methanol, ethanol, n-propanol, i-propanol, n-butanol, i-butanol, t-butanol, cyclohexyl alcohol, 1,2-ethanediol (ethylene glycol), 1,2-propanediol (propylene glycol) and the like are more suitably used.

As the alcohol represented by the general formula (2), cyclohexanol, 1,2-cyclohexanediol, 1,3-cyclohexanediol, 1,4-cyclohexanediol, 1,3,5-cyclohexanetriol and the like are suitably used.

As the alcohol represented by the general formula (3), 2-methoxyethanol, 2-ethoxyethanol, 2-(2-ethoxyethoxy) ethanol, diethylene glycol, triethylene glycol and the like are suitably used.

Of these alcohols, methanol, ethanol and isopropanol are particularly suitably used.

As for the content of these alcohols, 1 to 500 g/L is suitably used, 1 to 300 g/L is more suitably used, and 5 to 200 g/L is most suitably used.

Further, the silver colloidal solution used in the pretreatment for providing a catalyst in the present invention may further contain a colloid dispersant for the purpose of further stabilization of the colloid.

The colloid dispersant is used to aid adsorption by wetting the surface of an object to be plated and/or dispersion of the silver colloid. For these purposes, known colloid dispersants such as an amino-acid-based compound, a glycol-ether-based compound, a glycol-ester-based compound, cellulose and compounds based on derivatives thereof, a monosaccharide or polysaccharide and compounds based on derivatives thereof, a rubber-based compound, a surfactant and other polymer compounds can be used alone or in combination.

As examples of the amino-acid-based compound, betaine, glycine, alanine, valine, leucine, isoleucine, lysine, serine, threonine, phenylalanine, aspartic acid, glutamic acid and the like are suitably used.

As examples of the glycol-ether-based compound or glycol-ester-based compound, polyethylene glycol, polypropylene glycol, ethylene glycol monomethyl ether, ethylene glycol monoethyl ether, diethylene glycol monomethyl ether, diethylene glycol monoethyl ether, diethylene glycol dimethyl ether, triethylene glycol monomethyl ether, triethylene glycol monoethyl ether, diethylene glycol, lauryl polyethylene glycol ether, a condensate of a polyalcohol and ethyleneoxide, propylene glycol laurate and the like are suitably used.

As examples of the cellulose and compounds based on derivatives thereof, cellulose, methylcellulose, carboxymethylhexylcellulose, hydroxypropylcellulose, hydroxypropylmethylcellulose, hydroxyethylcellulose, carboxymethylcellulose and the like are suitably used.

As examples of the monosaccharide or polysaccharide and compounds based on derivatives thereof, cane sugar, mannitol, sorbitol, glycerol, inositol, dextrin, starch, hydroxyethylstarch, dextran, dextran sulfate, carboxymethyldextran, heparin, ascorbic acid, polyethoxy sorbitan laurate, polyethoxy sorbitan oleate and the like are suitably used.

Further, rubber-based compounds such as Ueran rubber, xanthan rubber and Ramsun rubber are also suitably used. Further, water-soluble organic solvents such as tetrahydrofuran, dioxane, acetone, sulfolane, lactam and lactone are also suitably used.

As the surfactant, nonionic, anionic, cationic and amphoteric surfactants are suitably used. Examples of compounds which can be suitably used are as follows.

As known cationic surfactants which are suitably used, onium ionic surfactants are suitably used. Those having halogen ions, i.e., chlorine, bromine and iodine ions, as counter ions are suitably used. Specific examples thereof include an alkyl trimethyl ammonium halide, an alkyl dimethyl benzyl ammonium halide, a trialkyl methyl ammonium halide, a trialkyl ammonium halide, (mono-, di- or tri-)2-hydroxyethyl ammonium halide, tetramethyl ammonium halide, tetrabutyl ammonium halide, perfluoroalkyl quaternary ammonium iodide, trimethylphenyl ammonium halide, dimethylcyclohexyl ammonium halide, methyl pyridinium halide, methyl quinolinium halide, alkyl methyl pyridinium halide, and the like. The alkyl is suitably an alkyl having 1 to 40 carbon atoms and particularly suitably dodecyl, cetyl, stearyl or behenyl. Specific examples thereof further include N,N-dimethyl piperidinium ammonium halide, N,N-dimethylmorpholino ammonium halide, N-methylmorpholino ammonium halide, N-ethylmorpholino ammonium halide, N,N-dimethylpiperadino ammonium halide, N-hydroxyethylpiperadino ammonium halide, N-methyl-2-methylpiperadino ammonium halide, N-methyl benzotriazolium halide, N-methyl-2-methylthiobenzimidazolium halide, 1-hydroxymethyl-1-methyl-2-cetylimidazolinium halide, polyvinyl imidazolium ammonium halide, halogenated alkyl imidazolinium betaine, and the like.

Specific examples of known anionic surfactants which are suitably used include an alkyl (or formalin condensate)-β-naphthalene sulfonic acid (sulfonate), a fatty acid soap based surfactant, an alkyl sulfonate, α-olefin sulfonate, an alkyl benzene sulfonate, an alkyl (or alkoxy)naphthalene sulfonate, an alkyl diphenyl ether disulfonate, an alkyl ether sulfonate, an alkyl sulfate, a polyoxyethylene alkyl ether sulfate, a polyoxyethylene alkyl phenol ether sulfate, a higher alcohol monophosphate, a polyoxyalkylene alkyl ether phosphoric acid (phosphate), a polyoxyalkylene alkyl phenyl ether phosphate, a polyoxyalkylene phenyl ether phosphate, a polyoxyethylene alkyl ether acetate, an alkyloyl sarcosine, an alkyloyl sarcosinate, an alkyloyl methylalanine salt, an N-acylsulfocarboxylate, an alkyl sulfoacetate, an acyl methyl taurate, an alkyl fatty acid glycerine sulfate, hardened coconut oil fatty acid glyceryl sulfate, an alkyl sulfocarboxylate, an alkyl sulfosuccinate, a dialkyl sulfosuccinate, an alkyl polyoxyethylene sulfosuccinate, an amidopolyoxyethylene sulfosuccinate, monooleylamide sulfosuccinate, and the like. The above salts include alkali metal salts, triethanolamine salts, ammonium salts and the like.

Specific examples of known nonionic surfactants which are suitably used include a polyalkylene glycol, a polyoxyalkylene alkyl ether (or ester), a polyoxyalkylene phenyl (or alkyl phenyl) ether, a polyoxyalkylene naphthyl (or alkyl naphthyl) ether, a polyoxyalkylene styrenated phenyl ether (or polyoxyalkylene styrenated phenyl ether having a polyoxyalkylene chain added to the phenyl group), a polyoxyalkylene bisphenol ether, a polyoxyethylene polyoxypropylene block polymer, a polyoxyalkylene sorbitan fatty acid ester, a polyoxyalkylene sorbit fatty acid ester, a polyethylene glycol fatty acid ester, a polyoxyalkylene glycerine fatty acid ester, a polyoxyalkylene alkyl amine, a condensation adduct of ethylenediamine and a polyoxyalkylene, a polyoxyalkylene fatty acid amide, a polyoxyalkylene castor (or/and hardened castor oil) oil, a polyoxyalkylene alkyl phenyl formalin condensate, glycerin (or polyglycerin) fatty acid ester, pentaerythritol fatty acid ester, sorbitan mono (sesqui, tri)fatty acid ester, higher fatty acid mono(di)ethanol amide, an alkyl alkylode amide, an oxyethylene alkyl amine, and the like.

Specific examples of known amphoteric surfactants which are suitably used include a 2-alkyl-N-carboxymethyl (or ethyl)-N-hydroxyethyl (or methyl)imidazolinium betaine, a 2-alkyl-N-carboxymethyl (or ethyl)-N-carboxymethyloxyethylimidazolinium betaine, a 2-alkyl-N-carboxymethyl (or ethyl)-N-hydroxyethyl (or methyl)imidazoline, a dimethyl alkyl betaine, pyridinium betaine, an N-alkyl-β-aminopropionic acid (or salt thereof), an alkyl (poly)aminoethyl glycine, an N-alkyl-N-methyl-β-alanine (or salt thereof), fatty acid amido propyldimethyl aminoacetic acid betaine, and the like. The above salts include alkali metal salts, triethanolamine salts, ammonium salts and the like.

Of the above surfactants, polyoxyethylene (or propylene) sorbitan fatty acid ester based surfactants, polyoxyethylene alkyl phenyl ether based surfactants, phosphoric esterified polyoxyethylene alkyl ether based surfactants, long-chain alkyl sodium sulfate based surfactants, halogenated alkyl trimethylammonium salt based surfactants and the like are suitably used.

In addition to these, other polymer compounds such as polyvinylpyrrolidone, polyvinylimidazole, polymers having an urea skeleton, an onium and an ether linkage in a principal chain, and the like are also suitably used.

Further, some of compounds refereed to as so-called fine-particle stabilizers or dispersants for fine-particles have still unidentified structures, and the surfactants and the polymer compounds other than the surfactants are included in those compounds. As such commercial dispersants, although some of them have already been mentioned in the above description of the surfactants, NEWCOL 25 (product of NIPPON NYUKAZAI CO., LTD.), EMULGEN 913 (product of KAO CORPORATION), SOLSPARSE 43000 (product of AVECIA CO., LTD.), PHOSPHANOL RE-410 (product of TOHO CHEMICAL INDUSTRY CO., LTD.), REODOL TW-L120 (product of KAO CORPORATION), a polyvinyl pyrrolidone, a polyvinyl imidazole and the like are suitably used.

The amount of the colloid dispersant may be changed as appropriate according to the type of the dispersant used. However, the amount is preferably about 0.01 to 100 g/L, more preferably 0.01 to 50 g/L.

The silver colloidal catalyst solution of the present invention may further contain one or more sulfur-containing compounds. By use of a solution containing the sulfur-containing compounds, a finer silver colloid can be produced.

Illustrative examples of sulfur-containing compounds which are used for the above purpose include thiourea, thioacetamide, ethylenethiourea, trimethylthiourea, 1-allyl-2-thiourea, thiosemicarbazide, 2-mercaptobenzothiazole, 2-mercaptobenzimidazole, 2-mercaptobenzoxazole, mercaptosuccinic acid, mercaptoacetic acid, mercaptopropionic acid, acetylcysteine, thioglycolic acid, and the like.

The content of the sulfur-containing compound may be changed as appropriate according to the type of the sulfur-containing compound used. However, 1 mg/L to 50 g/L is generally suitably used, and 10 mg/L to 5 g/L is more suitably used.

The silver colloidal solution used in the pretreatment for providing a catalyst in the present invention may further contain palladium in an amount of not larger than 1/100 of the amount of silver. Since palladium has excellent catalytic activity, it is self-evident that a solution having good catalytic activity can be produced when a sufficient amount of palladium is contained in the solution. However, it has been found that the catalytic activity of the silver colloidal solution of the present invention can be further increased with a lower content of palladium than the lowest content in which a palladium based solution for providing a catalyst generally shows the effect.

The silver colloidal solution used in the pretreatment for providing a catalyst in the present invention may further contain one or more compounds selected from a pH buffer and a reducing compound. As these compounds, known compounds can be used.

As the pH buffer, ammonium chloride, sodium, potassium and ammonium salts of phosphoric acid, acetic acid, boric acid and tartaric acid, and an acidic salt containing hydrogen ions in the case of a polybasic acid, are mixed together as appropriate and used. The pH buffer is suitably used in an amount of about 1 to 50 g/L, preferably about 1 to 20 g/L.

To prevent excessive oxidation of metal ions having an electric potential which can reduce silver ions to metal silver in the solution by dissolved oxygen and stabilize the silver colloidal solution, the silver colloidal solution preferably further contains reducing compounds. As these reducing agents, an alkyl or phenyl phosphine is suitably used, and tris(3-hydroxypropylphosphine) is more suitably used. Further, as these reducing agent, so-called antioxidants such as phosphinic acid, resorcinol, pyrocatechol, hydroquinone, fluoroglycinol, pyrogallol, hydrazine, ascorbic acid and the like can also be used. Of these, ascorbic acid is particularly suitably used.

These reducing compounds can be used alone or in admixture as appropriate. The reducing compound is suitably used in an amount of about 0.05 to 50 g/L, more preferably about 0.1 to 10 g/L.

The silver colloidal solution used in the pretreatment for providing a catalyst in the present invention gives good catalytic activity when it has pH ranging from strong acidity to alkalinity of about pH 12. To keep the silver colloid in a stable condition over a long time period, a pH of 3 to 11 is more suitably desirable. A pH of 4 to 9 is more suitably used, and a pH of 6 to 9 is most suitably used.

To prepare the silver colloidal solution so as to have the most suitable pH as described above, it can be prepared by adjusting a solution containing metal ions having an electric potential which can reduce silver ions to metal silver in the solution and a complexing agent for the ions so as to have a pH of 3 to 11 in advance and then mixing the adjusted solution with a solution containing a silver compound. Alternatively, it can also be prepared by mixing the solution containing metal ions having an electric potential which can reduce silver ions to metal silver in the solution and a complexing agent for the ions with the solution containing a silver compound and then adjusting the mixed solution so as to have a pH of 3 to 11.

When the silver colloidal solution is used under acidic conditions below pH 3, the silver colloidal solution can be stable and have high catalytic activity by preparing the solution so as to have a pH of 3 to 11 once as described above and then reducing the pH to acidity.

To obtain finer silver colloid particles, a solution containing metal ions having an electric potential which can reduce silver ions to metal silver in the solution and one or more ions selected from a hydroxycarboxylate ion, a condensed phosphate ion and an amine carboxylate ion is desirably heated to at least 50° C. when a solution having a silver compound dissolved therein is added and mixed into the above solution so as to prepare the silver colloidal solution. Further, in this case, to inhibit excessive oxidation of the metal ions having an electric potential which can reduce silver ions to metal silver in the solution, it is desirable to blow an inert gas such as nitrogen into the solution.

The silver colloidal solution used in the pretreatment for providing a catalyst in the present invention can provide good catalytic activity even when used immediately after its preparation. However, it can provide better catalytic activity after left to stand at room temperature or an elevated temperature for at least 24 hours after its preparation. In this case, although the temperature at which it is left to stand is not particularly limited, 30 to 70° C. is generally suitably used, and 50° C. or higher is more preferred. When it is left to strand at 50° C. or higher, finer silver colloid particles are produced and effective for an improvement in the catalytic activity and long-term stabilization of the bath.

In general, the silver colloidal solution of the present invention can be used in the concentration when it is prepared, in the step of providing a catalyst. However, the silver colloidal solution may be diluted with water or an aqueous solution containing the components contained in the silver colloidal solution. A dilution rate of up to 20 times is suitably used.

However, as described above, the silver colloidal solution prepared by mixing under heating or leaving to stand at an elevated temperature has higher catalytic activity than the solution prepared at room temperature. Thus, even if diluted to 3 to 20 times, it can provide as good catalytic activity as the non-diluted solution immediately after preparation at room temperature.

The method of the present invention for providing a catalyst for electroless plating is basically a method which carries out a step of treating an object to be plated with the above silver colloidal solution in place of a step of treating an object to be plated with a tin chloride/palladium colloid in a known method of providing a catalyst so as to adsorb the silver colloid to the object to be plated and use the adsorbed colloid as a catalyst nucleus. Although it is still possible to provide catalytic activity only by the step of immersing the object to be plated in the silver colloidal solution, the immersed object may be further treated with an acid solution or a solution containing a reducing agent after the treatment with the silver colloidal solution. This solution may contain a trace amount of copper ions in some cases. That is, known methods and known treatment solutions can be used for other steps, i.e., a degreasing step, an etching step, a conditioning step comprising a treatment with a solution for adjusting a surface charge, e.g., a treatment with a solution containing a polymer containing quaternary ammonium, and a plating step.

Accordingly, in general, after the degreasing, etching and conditioning steps, an object to be plated is immersed in the silver colloidal solution and then undergoes the plating step. Alternatively, after immersed in the silver colloidal solution, the object to be plated is immersed in the acid solution or solution containing a reducing agent and then undergoes the plating step. As a matter of course, a step of rinsing the object to be plated with water may be inserted in between these steps. Further, the above steps of immersing the object to be plated may be substituted with steps of applying the solutions to the object to be plated.

In addition, a drying step may be carried out after immersion of the object to be plated in the silver colloidal solution or immersion of the object to be plated in the acid solution or solution containing a reducing agent. The drying step does not cause deterioration in catalytic activity. Rather, although depending on conditions, the catalytic activity improves. Although the reason for this is unknown, it is assumed that drying enhances adsorption of the active ingredients, making good plating possible.

As for the kind of electroless plating, copper, silver or nickel (alloy) is suitably used. Electroless copper plating and electroless silver plating are more suitably used, and electroless copper plating is most suitably used.

As the reducing agent used in the above solution containing a reducing agent, any of a hypophosphite, dimethylamine borane, sodium borohydride, a tetravalent titanium ion and a divalent cobalt ion is suitably used. Of these, the dimethylamine borane is more suitably used.

In the silver colloidal solution, when tin is used as the metal ions having an electric potential which can reduce silver ions to metal silver in the solution, the content of divalent tin influences catalytic activity and bath stability. The content changes as electroless plating is carried out continuously over a long time. Therefore, in the case of such a plating method, it is desirable to adjust the content of the divalent tin ions. In that case, although it is also possible to add a tin salt, an electrolysis method comprising producing divalent tin ions continuously by oxidation of a tin anode is desirable from the viewpoints of workability and prevention of contamination by impurities.

When divalent tin ions are produced at an anode by the above electrolysis method, the produced divalent tin ions reach a cathode where the tin ions are reduced to metal tin. Thus, to produce the divalent tin ions efficiently, it is desirable to separate the cathode and the anode from each other by a membrane.

The membrane may be any material through which divalent tin ions hardly physically pass so as to reach a cathode. For example, a glass filter or cloth can be used. Further, when a variety of ion exchange membranes are used so as to make it difficult for the divalent tin ions to reach the cathode in terms of electric charges as well, more efficient electrolysis becomes possible.

Not to mention an ornament material (component), an object plated by electroless plating using the above pretreatment for providing a catalyst for electroless plating is suitably used as an electric/electronic material (component) (such as through hole plating of a printed wiring board and EMI shield plating of an equipment case), a cell material (component) or an optical communication material (component), and the material can suitably constitute an electric/electronic apparatus, a cell or an optical communication device.

EXAMPLES

Hereinafter, the present invention will be described in detail with reference to Examples. The present invention is not limited to these Examples and may be modified within the scope of the present invention.

Example 1

The following solution (a-1) was prepared. The pH of the solution was 8.

Solution (1-a):

| | |
|---|---|
| ion exchanged water | 520 g |
| potassium pyrophosphate | 66 g |
| tin sulfate (as tin) | 12 g |

The following solution (1-b) was prepared separately and added dropwise and mixed into the above solution (1-a) so as to prepare a silver colloidal solution (1-c). The pH of the mixture was 7.

Solution (1-b):

| | |
|---|---|
| ion exchanged water | 400 g |
| silver sulfate (as silver) | 1 g |

This solution (1-c) was directly used as a solution for providing a catalyst for electroless copper plating.

After an ABS resin sample subjected to pretreatments, i.e., etching and conditioning, in accordance with a conventional method was immersed in the solution (1-c) for 5 minutes, the sample was rinsed with water and then immersed in the following solution (1-d) containing a reducing agent for 3 minutes. Then, the sample was rinsed with water and then immersed in an electroless copper plating solution (1-e).

Solution (1-d)

| | |
|---|---|
| dimethylamine borane | 2 g/L |
| NaOH | 2 g/L |

Electroless Copper Plating Solution (1-e)

| | |
|---|---|
| copper sulfate | 10 g/L |
| Rochelle salt | 30 g/L |
| Formalin (37%) | 30 g/L |
| caustic soda | 20 g/L |
| 2,2'-bipyridyl | 0.02 g/L |
| temperature of bath | 25° C. |

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Comparative Example 1

A silver colloidal solution was prepared in accordance with the following known method. That is, after the following solution (1-g) was added dropwise and mixed into the following solution (1-f) so as to prepare a silver colloidal solution, the following solution (1-h) was added to the obtained silver colloidal solution so as to prepare a silver fine particle dispersed solution, and the pH of the solution was adjusted to 2.5 (1-i).

Solution (1-f):

| | |
|---|---|
| ion exchanged water | 800 ml |
| silver sulfate | 10 mmol |

Solution (1-g):

| | |
|---|---|
| ion exchanged water | 800 ml |
| polyoxyethylene stearyl ether phosphoric acid | 500 mg |
| dimethylamine borane | 5 mmol |

Solution (1-h)

| | |
|---|---|
| ion exchanged water | 50 ml |
| nickel sulfate | 2 mmol |

This solution was directly used as a solution for providing a catalyst for electroless copper plating.

After an ABS resin sample subjected to pretreatments, i.e., etching and conditioning, in accordance with a conventional method was immersed in the solution (1-i) for 5 minutes, the sample was rinsed with water and then immersed in the electroless copper plating solution (1-e). The start of deposition of copper plating was obviously slower than that of Example 1, and the appearance of the plating was browner than that of Example 1.

The resulting sample was heat-treated at 100° C. for 2 hours and then cross-cut to a width of 2 mm so as to conduct a tape peel test. As a result, peeling of the plated film was observed.

Example 2

Immediately after the solution (1-c) for providing a catalyst in Example 1 was prepared, it was diluted to 10 times so as to prepare a solution (2-c). The pH of the solution was 7. This solution (2-c) was used as a solution for providing a catalyst for electroless copper plating.

A sample was subjected to electroless copper plating in the same manner as in Example 1. Although good plating was obtained as in Example 1, the start of deposition of copper plating was slightly slower than that of Example 1. The resulting sample was heat-treated at 100° C. for 2 hours and then cross-cut to a width of 2 mm so as to conduct a tape peel test. As a result, peeling of the plated film was not observed.

Example 3

After the solution (1-c) for providing a catalyst in Example 1 was left to stand at 50° C. for at least 24 hours, it was diluted to 10 times so as to prepare a solution (3-c). The pH of the solution was 7.

This solution (3-c) was directly used as a solution for providing a catalyst for electroless copper plating.

After an ABS resin sample subjected to pretreatments, i.e., etching and conditioning, in accordance with a conventional method was immersed in the solution (3-c) for 5 minutes, the sample was rinsed with water and then immersed in the solution (1-d) containing a reducing agent for 3 minutes. Then, the sample was rinsed with water and then immersed in the electroless copper plating solution (1-e). After plated for 20 minutes, the sample was rinsed with water and dried. A good electroless copper plated film was obtained.

The resulting sample was heat-treated at 100° C. for 2 hours and then cross-cut to a width of 2 mm so as to conduct a tape peel test. As a result, peeling of the plated film was not observed.

Example 4

The following solution (4-a) was prepared. The pH of the solution was 7.

Solution (4-a)

| | |
|---|---|
| ion exchanged water | 485 g |
| potassium pyrophosphate | 100 g |
| tin chloride (as tin) | 15 g |

The following solution (4-b) was prepared separately and added dropwise and mixed into the above solution (4-a) so as to prepare a silver colloidal solution. After mixing, the pH of the resulting solution was adjusted to 6 by use of sulfuric acid (4-c).

Solution (4-b):

| | |
|---|---|
| ion exchanged water | 400 g |
| silver sulfate (as silver) | 1 g |

After this solution (4-c) was left to stand for at least 24 hours, the solution was directly used as a solution (4-c') for providing a catalyst for electroless copper plating.

After an ABS resin sample subjected to pretreatments, i.e., etching and conditioning, in accordance with a conventional method was immersed in the solution (4-c') for 5 minutes, the sample was rinsed with water and then directly immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 5

The following solution (5-a) was prepared. The pH of the solution was 9.

Solution (5-a)

| | |
|---|---|
| ion exchanged water | 560 g |
| potassium pyrophosphate | 33 g |
| tin pyrophosphate (as tin) | 6 g |

The following solution (5-b) was prepared separately and added dropwise and mixed into the above solution (5-a) so as to prepare a silver colloidal solution. After mixing, the pH of the resulting solution was adjusted to 6 by use of sulfuric acid (5-c).

Solution (5-b):

| | |
|---|---|
| ion exchanged water | 400 g |
| silver nitrate (as silver) | 0.5 g |

After this solution (5-c) was left to stand for at least 24 hours, the solution was directly used as a solution (5-c') for providing a catalyst for electroless copper plating.

After an ABS resin sample subjected to pretreatments, i.e., etching and conditioning, in accordance with a conventional method was immersed in the solution (5-c') for 5 minutes, the sample was rinsed with water and then immersed in the following solution (5-d) for 3 minutes. After rinsed with water, the sample was immersed in the electroless copper plating solution (1-e).

Solution (5-d)

| | |
|---|---|
| sulfuric acid | 100 g |
| ion exchanged water | 900 g |

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 6

The following solution (6-a) was prepared. The pH of the solution was 8.

Solution (6-a)

| | |
|---|---|
| ion exchanged water | 370 g |
| potassium pyrophosphate | 200 g |
| tin sulfamate (as tin) | 30 g |
| polyoxyalkylene naphthyl ether | 0.5 g |

The following solution (6-b) was prepared separately and added dropwise and mixed into the above solution (6-a) so as to prepare a silver colloidal solution. After mixing, the pH of the resulting solution was adjusted to 4 by use of sulfuric acid (6-c).

Solution (6-b):

| | |
|---|---|
| ion exchanged water | 400 g |
| silver nitrate (as silver) | 2 g |

After this solution (6-c) was left to stand for at least 24 hours, the solution was directly used as a solution (6-c') for providing a catalyst for electroless copper plating.

After an ABS resin sample subjected to pretreatments, i.e., etching and conditioning, in accordance with a conventional method was immersed in the solution (6-c') for 5 minutes, the sample was rinsed with water and then immersed in the solution (1-d) for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 7

The following solution (7-a) was prepared. The pH of the solution was 7.

Solution (7-a)

| | |
|---|---|
| ion exchanged water | 540 g |
| potassium pyrophosphate | 55 g |
| tin methanesulfonate (as tin) | 6 g |
| tetrabutylammonium halide | 0.5 g |

The following solution (7-b) was prepared separately and added dropwise and mixed into the above solution (7-a) so as to prepare a silver colloidal solution (7-c). After mixing, the pH of the resulting solution was adjusted to 7 by use of KOH (7-c).

Solution (7-b):

| | |
|---|---|
| ion exchanged water | 400 g |
| silver methanesulfonate (as silver) | 0.4 g |

After this solution (7-c) was left to stand for at least 24 hours, the solution was directly used as a solution (7-c') for providing a catalyst for electroless copper plating.

After an ABS resin sample subjected to pretreatments, i.e., etching and conditioning, in accordance with a conventional method was immersed in the solution (7-c') for 5 minutes, the sample was rinsed with water and then immersed in the following solution (7-d) for 3 minutes. After rinsed with water, the sample was immersed in the electroless copper plating solution (1-e).

Solution (7-d)

| | |
|---|---|
| methanesulfonic acid | 100 g |
| ion exchanged water | 900 g |

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 8

The following solution (8-a) was prepared. The pH of the solution was 7.

Solution (8-a)

| | |
|---|---|
| ion exchanged water | 560 g |
| potassium pyrophosphate | 33 g |
| tin phenolsulfonate (as tin) | 6 g |
| alkylnaphthalenesulfonic acid | 0.5 g |

The following solution (8-b) was prepared separately and added dropwise and mixed into the above solution (8-a) so as to prepare a silver colloidal solution. After mixing, the pH of the resulting solution was adjusted to 8 by use of KOH (8-c).

Solution (8-b):

| | |
|---|---|
| ion exchanged water | 400 g |
| silver nitrate (as silver) | 0.5 g |

After this solution (8-c) was left to stand for at least 24 hours, the solution was directly used as a solution (8-c') for providing a catalyst for electroless copper plating.

After an ABS resin sample subjected to pretreatments, i.e., etching and conditioning, in accordance with a conventional method was immersed in the solution (8-c') for 5 minutes, the sample was rinsed with water and then immersed in the solution (1-d) for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 9

The following solution (9-a) was prepared. The pH of the solution was 7.

Solution (9-a)

| | |
|---|---|
| ion exchanged water | 480 g |
| potassium pyrophosphate | 100 g |
| tin phenolsulfonate (as tin) | 18 g |
| dimethyl alkyl betaine | 0.5 g |

The following solution (9-b) was prepared separately and added dropwise and mixed into the above solution (9-a) so as to prepare a silver colloidal solution. After mixing, the pH of the resulting solution was adjusted to 8 by use of KOH (9-c).

Solution (9-b):

| | |
|---|---|
| ion exchanged water | 400 g |
| silver nitrate (as silver) | 1.5 g |

After this solution (9-c) was left to stand for at least 24 hours, the solution was directly used as a solution (9-c') for providing a catalyst for electroless copper plating.

After an ABS resin sample subjected to pretreatments, i.e., etching and conditioning, in accordance with a conventional method was immersed in the solution (9-c') for 5 minutes, the sample was rinsed with water and then immersed in the solution (6-d) for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 10

The following solution (10-a) was prepared. The pH of the solution was 7.

Solution (10-a)

| | |
|---|---|
| ion exchanged water | 580 g |
| potassium pyrophosphate | 13 g |
| tin sulfate (as tin) | 5 g |
| citric acid | 1 g |

The following solution (10-b) was prepared separately and added dropwise and mixed into the above solution (10-a) so as to prepare a silver colloidal solution. After mixing, the pH of the resulting solution was adjusted to 5 by use of methanesulfonic acid (10-c).

Solution (10-b):

| | |
|---|---|
| ion exchanged water | 400 g |
| silver methanesulfonate (as silver) | 0.4 g |

After this solution (10-c) was left to stand for at least 24 hours, the solution was directly used as a solution (10-c') for providing a catalyst for electroless copper plating.

After an ABS resin sample subjected to pretreatments, i.e., etching and conditioning, in accordance with a conventional method was immersed in the solution (10-c') for 5 minutes, the sample was rinsed with water and then immersed in the following solution (10-d) containing a reducing agent for 3 minutes. After rinsed with water, the sample was immersed in the electroless copper plating solution (1-e).

Solution (10-d)

| | |
|---|---|
| sodium hypophosphite | 5 g/L |
| NaOH | 5 g/L |

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 11

The following solution (11-a) was prepared. The pH of the solution was 7.

Solution (11-a)

| | |
|---|---|
| ion exchanged water | 560 g |
| potassium pyrophosphate | 30 g |
| tin sulfate (as tin) | 8 g |
| lactic acid | 1 g |

The following solution (11-b) was prepared separately and added dropwise and mixed into the above solution (11-a) so as to prepare a silver colloidal solution. After mixing, the pH of the resulting solution was adjusted to 5 by use of sulfuric acid (11-c).

Solution (11-b):

| | |
|---|---|
| ion exchanged water | 400 g |
| silver sulfate (as silver) | 0.8 g |

After this solution (11-c) was left to stand for at least 24 hours, the solution was directly used as a solution (11-c') for providing a catalyst for electroless copper plating.

After an ABS resin sample subjected to pretreatments, i.e., etching and conditioning, in accordance with a conventional method was immersed in the solution (11-c') for 5 minutes, the sample was rinsed with water and then immersed in the following solution (11-d) containing a reducing agent for 3 minutes. After rinsed with water, the sample was immersed in the electroless copper plating solution (1-e).

Solution (11-d)

| | |
|---|---|
| sodium borohydride | 2 g/L |
| NaOH | 2 g/L |

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 12

The following solution (12-a) was prepared. The pH of the solution was 7.

Solution (12-a)

| | |
|---|---|
| ion exchanged water | 550 g |
| potassium pyrophosphate | 40 g |
| tin sulfate (as tin) | 10 g |
| sodium stannate | 2 g |

The following solution (12-b) was prepared separately and added dropwise and mixed into the above solution (12-a) so as to prepare a silver colloidal solution. After mixing, the pH of the resulting solution was adjusted to 5 by use of sulfuric acid (12-c).

Solution (12-b):

| | |
|---|---|
| ion exchanged water | 400 g |
| silver sulfate (as silver) | 1 g |

After this solution (12-c) was left to stand for at least 24 hours, the solution was directly used as a solution (12-c') for providing a catalyst for electroless copper plating.

After an ABS resin sample subjected to pretreatments, i.e., etching and conditioning, in accordance with a conventional method was immersed in the solution (12-c') for 5 minutes, the sample was rinsed with water and then immersed in the solution (1-d) for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 13

The following solution (13-a) was prepared. The pH of the solution was 7.

Solution (13-a)

| | |
|---|---|
| ion exchanged water | 520 g |
| potassium pyrophosphate | 70 g |
| tin methanesulfonate (as tin) | 10 g |
| copper sulfate (concentration of copper) | 0.01 g |

The following solution (13-b) was prepared separately and added dropwise and mixed into the above solution (13-a) so as to prepare a silver colloidal solution. After mixing, the pH of the resulting solution was adjusted to 8 by use of KOH (13-c).

Solution (13-b):

| | |
|---|---|
| ion exchanged water | 400 g |
| silver methanesulfonate (as silver) | 1 g |

After this solution (13-c) was left to stand for at least 24 hours, the solution was directly used as a solution (13-c') for providing a catalyst for electroless copper plating.

After an ABS resin sample subjected to pretreatments, i.e., etching and conditioning, in accordance with a conventional method was immersed in the solution (13-c') for 5 minutes, the sample was rinsed with water and then immersed in the following solution (13-d) containing a reducing agent for 3 minutes. After rinsed with water, the sample was immersed in the electroless copper plating solution (1-e).

Solution (13-d)

| | |
|---|---|
| cobalt sulfate | 0.15 mol/L |
| ethylenediamine | 0.6 mol/L |
| pH | 8 |

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 14

The following solution (14-a) was prepared. The pH of the solution was 7.

Solution (14-a)

| | |
|---|---|
| ion exchanged water | 540 g |
| potassium pyrophosphate | 50 g |
| tin methanesulfonate (as tin) | 10 g |
| nickel chloride (as nickel) | 0.01 g |

The following solution (14-b) was prepared separately and added dropwise and mixed into the above solution (14-a) so as to prepare a silver colloidal solution. After mixing, the pH of the resulting solution was adjusted to 7 by use of KOH (14-c)

Solution (14-b):

| | |
|---|---|
| ion exchanged water | 400 g |
| silver methanesulfonate (as silver) | 1 g |

After this solution (14-c) was left to stand for at least 24 hours, the solution was directly used as a solution (14-c') for providing a catalyst for electroless copper plating.

After an ABS resin sample subjected to pretreatments, i.e., etching and conditioning, in accordance with a conventional method was immersed in the solution (14-c') for 5 minutes, the sample was rinsed with water and then immersed in the following solution (14-d) containing a reducing agent for 3 minutes. After rinsed with water, the sample was immersed in the electroless copper plating solution (1-e).

Solution (14-d)

| | |
|---|---|
| titanium trichloride | 0.08 mol/L |
| citric acid | 0.24 mol/L |
| pH | 9 |

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 15

The following solution (15-a) was prepared. The pH of the solution was 7.

Solution (15-a)

| | |
|---|---|
| ion exchanged water | 540 g |
| potassium pyrophosphate | 50 g |
| tin methanesulfonate (as tin) | 10 g |
| palladium sulfate (as palladium) | 0.01 g |

The following solution (15-b) was prepared separately and added dropwise and mixed into the above solution (15-a) so as to prepare a silver colloidal solution. After mixing, the pH of the resulting solution was adjusted to 4 by use of methanesulfonic acid (15-c).

Solution (15-b):

| | |
|---|---|
| ion exchanged water | 400 g |
| silver methanesulfonate (as silver) | 1 g |

After this solution (15-c) was left to stand for at least 24 hours, the solution was directly used as a solution (15-c') for providing a catalyst for electroless copper plating.

After an ABS resin sample subjected to pretreatments, i.e., etching and conditioning, in accordance with a conventional method was immersed in the solution (15-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 16

The following solution (16-a) was prepared. The pH of the solution was 7.

Solution (16-a)

| | |
|---|---|
| ion exchanged water | 380 g |
| potassium pyrophosphate | 200 g |
| tin sulfate (as tin) | 25 g |
| hydroquinone | 1 g |

The following solution (16-b) was prepared separately and added dropwise and mixed into the above solution (16-a) so as to prepare a silver colloidal solution. After mixing, the pH of the resulting solution was adjusted to 8 by use of KOH (16-c).

Solution (16-b):

| | |
|---|---|
| ion exchanged water | 400 g |
| silver nitrate (as silver) | 2 g |

After this solution (16-c) was left to stand for at least 24 hours, the solution was directly used as a solution (16-c') for providing a catalyst for electroless copper plating.

After an ABS resin sample subjected to pretreatments, i.e., etching and conditioning, in accordance with a conventional method was immersed in the solution (16-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 17

The following solution (17-a) was prepared. The pH of the solution was 7.

Solution (17-a)

| | |
|---|---|
| ion exchanged water | 550 g |
| potassium pyrophosphate | 40 g |
| tin methanesulfonate (as tin) | 6 g |
| polyethylene glycol | 0.5 g |

The following solution (17-b) was prepared separately and added dropwise and mixed into the above solution (17-a) so as to prepare a silver colloidal solution. After mixing, the pH of the resulting solution was adjusted to 6 by use of methanesulfonic acid (17-c).

Solution (17-b):

| | |
|---|---|
| ion exchanged water | 400 g |
| silver methanesulfonate (as silver) | 0.6 g |

After this solution (17-c) was left to stand for at least 24 hours, the solution was directly used as a solution (17-c') for providing a catalyst for electroless copper plating.

After an ABS resin sample subjected to pretreatments, i.e., etching and conditioning, in accordance with a conventional method was immersed in the solution (17-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 18

The following solution (18-a) was prepared. The pH of the solution was 7.

Solution (18-a)

| | |
|---|---|
| ion exchanged water | 570 g |
| potassium pyrophosphate | 25 g |
| tin methanesulfonate (as tin) | 3 g |

carboxymethyl cellulose 1 g

The following solution (18-b) was prepared separately and added dropwise and mixed into the above solution (18-a) so as to prepare a silver colloidal solution. After mixing, the pH of the resulting solution was adjusted to 4 by use of methanesulfonic acid (18-c).

Solution (18-b):

| | |
|---|---|
| ion exchanged water | 400 g |
| silver methanesulfonate (as silver) | 0.3 g |

After this solution (18-c) was left to stand for at least 24 hours, the solution was directly used as a solution (18-c') for providing a catalyst for electroless copper plating.

After an ABS resin sample subjected to pretreatments, i.e., etching and conditioning, in accordance with a conventional method was immersed in the solution (18-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 19

The following solution (19-a) was prepared. The pH of the solution was 7.

Solution (19-a)

| | |
|---|---|
| ion exchanged water | 560 g |
| potassium pyrophosphate | 30 g |
| tin methanesulfonate (as tin) | 6 g |
| cane sugar | 1 g |

The following solution (19-b) was prepared separately and added dropwise and mixed into the above solution (19-a) so as to prepare a silver colloidal solution. After mixing, the pH of the resulting solution was adjusted to 8 by use of KOH (19-c).

Solution (19-b):

| | |
|---|---|
| ion exchanged water | 400 g |
| silver methanesulfonate (as silver) | 0.6 g |

After this solution (19-c) was left to stand for at least 24 hours, the solution was directly used as a solution (19-c') for providing a catalyst for electroless copper plating.

After an ABS resin sample subjected to pretreatments, i.e., etching and conditioning, in accordance with a conventional method was immersed in the solution (19-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 20

The following solution (20-a) was prepared. The pH of the solution was 8.

Solution (20-a)

| | |
|---|---|
| ion exchanged water | 520 g |
| potassium pyrophosphate | 66 g |
| tin sulfate (as tin) | 12 g |

The following solution (20-b) was prepared separately and added dropwise and mixed into the above solution (20-a) so as to prepare a silver colloidal solution (20-c). After mixing, the pH of the resulting solution was 7.

Solution (20-b):

| | |
|---|---|
| ion exchanged water | 400 g |
| silver nitrate (as silver) | 1 g |

This solution (20-c) was directly used as a solution for providing a catalyst for electroless silver plating.

After an ABS resin sample subjected to pretreatments, i.e., etching and conditioning, in accordance with a conventional method was immersed in the solution (20-c) for 5 minutes, the sample was rinsed with water and then immersed in the following solution (20-d) containing a reducing agent for 3 minutes. After rinsed with water and dried, the sample was immersed in an electroless silver plating solution (20-e).

Solution (20-d)

| | |
|---|---|
| dimethylamine borane | 2 g/L |
| NaOH | 2 g/L |

Electroless Silver Plating Solution (20-e)

| | |
|---|---|
| silver sulfate | 10 g/L |
| Rochelle salt | 30 g/L |
| Formalin (37%) | 33 g/L |
| caustic soda | 20 g/L |
| 2,2'-bipyridyl | 0.02 g/L |
| temperature of bath | 25° C. |

After plated for 60 minutes, the sample was rinsed with water and dried. A good electroless silver plated film was obtained. The resulting sample was cross-cut to a width of 2 mm so as to conduct a tape peel test. As a result, peeling of the plated film was not observed.

Comparative Example 2

A silver fine particle dispersed solution was prepared in the same manner as in Comparative Example 1. This solution was directly used as a solution for providing a catalyst for electroless silver plating.

A sample was subjected to electroless silver plating under the same conditions as those in Example 20, and a tape peel test was conducted under the same conditions as those in Example 20. Peeling of the silver plated film was observed at 7 spots out of 100 spots.

Example 21

The following solution (21-a) was prepared. The pH of the solution was 7.

Solution (21-a)

| | |
|---|---|
| ion exchanged water | 570 g |
| potassium pyrophosphate | 25 g |
| tin methanesulfonate (as tin) | 3 g |
| SOLSPARSE 43000 | 5 g |

The following solution (21-b) was prepared separately and added dropwise and mixed into the above solution (21-a) so as to prepare a silver colloidal solution. After mixing, the pH of the resulting solution was adjusted to 4 by use of methanesulfonic acid (21-c).

Solution (21-b):

| | |
|---|---|
| ion exchanged water | 400 g |
| silver methanesulfonate (as silver) | 0.3 g |

After this solution (21-c) was left to stand at 55° C. for at least 24 hours, the solution was directly used as a solution (21-c') for providing a catalyst for electroless copper plating.

After an ABS resin sample subjected to pretreatments, i.e., etching and conditioning, in accordance with a conventional method was immersed in the solution (21-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 22

The following solution (22-a) was prepared. The pH of the solution was 7.

Solution (22-a)

| | |
|---|---|
| ion exchanged water | 380 g |
| potassium pyrophosphate | 200 g |
| tin sulfate (as tin) | 25 g |
| tris(3-hydroxypropyl)phosphine | 1 g |

The following solution (22-b) was prepared separately and added dropwise and mixed into the above solution (22-a) so as to prepare a silver colloidal solution. After mixing, the pH of the resulting solution was adjusted to 8 by use of KOH (22-c).

Solution (22-b):

| | |
|---|---|
| ion exchanged water | 400 g |
| silver nitrate (as silver) | 2 g |

After this solution (22-c) was left to stand for at least 24 hours, the solution was directly used as a solution (22-c') for providing a catalyst for electroless copper plating.

After an ABS resin sample subjected to pretreatments, i.e., etching and conditioning, in accordance with a conventional method was immersed in the solution (22-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 23

The following solution (23-a) was prepared. The pH of the solution was 7.

Solution (23-a)

| | |
|---|---|
| ion exchanged water | 380 g |
| potassium pyrophosphate | 120 g |
| sodium gluconate | 100 g |
| tin sulfate (as tin) | 25 g |
| ascorbic acid | 1 g |

The following solution (23-b) was prepared separately and added dropwise and mixed into the above solution (23-a) so as to prepare a silver colloidal solution. After mixing, the pH of the resulting solution was adjusted to 4 by use of methanesulfonic acid (23-c).

Solution (23-b):

| | |
|---|---|
| ion exchanged water | 400 g |
| silver nitrate (as silver) | 2 g |

After this solution (23-c) was left to stand for at least 24 hours, the solution was directly used as a solution (23-c') for providing a catalyst for electroless copper plating.

After an ABS resin sample subjected to pretreatments, i.e., etching and conditioning, in accordance with a conventional method was immersed in the solution (23-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 24

The following solution (24-a) was prepared. The pH of the solution was 7.

Solution (24-a)

| | |
|---|---|
| ion exchanged water | 380 g |
| potassium tartrate | 200 g |
| tin methanesulfonate (as tin) | 25 g |
| REODOLE TW-L120 | 1 g |

The following solution (24-b) was prepared separately and added dropwise and mixed into the above solution (24-a) so as to prepare a silver colloidal solution. After mixing, the pH of the resulting solution was 6.7 (24-c).

Solution (24-b):

| | |
|---|---|
| ion exchanged water | 500 g |
| silver methanesulfonate (as silver) | 1 g |

This solution (24-c) was directly used as a solution (24-c') for providing a catalyst for electroless copper plating.

After an ABS resin sample subjected to pretreatments, i.e., etching and conditioning, in accordance with a conventional method was immersed in the solution (24-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 25

The following solution (25-a) was prepared. The pH of the solution was 7.

Solution (25-a)

| | |
|---|---|
| ion exchanged water | 380 g |
| potassium pyrophosphate | 200 g |
| tin methanesulfonate (as tin) | 20 g |
| PHOSPHANOL RE-410 | 8 g |
| ascorbic acid | 2 g |

The following solution (25-b) was prepared separately and added dropwise and mixed into the above solution (25-a) so as to prepare a silver colloidal solution. After mixing, the pH of the resulting solution was adjusted to 8 by use of KOH (25-c)

Solution (25-b):

| | |
|---|---|
| ion exchanged water | 400 g |
| silver nitrate (as silver) | 2 g |

After this solution (25-c) was left to stand for at least 24 hours, the solution was directly used as a solution (25-c') for providing a catalyst for electroless copper plating.

After an ABS resin sample subjected to pretreatments, i.e., etching and conditioning, in accordance with a conventional method was immersed in the solution (25-c') for 5 minutes, the sample was dried at 80° C. for 3 hours and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 26

The following solution (26-a) was prepared. The pH of the solution was 7.

Solution (26-a)

| | |
|---|---|
| ion exchanged water | 380 g |
| potassium pyrophosphate | 300 g |
| tin sulfate (as tin) | 30 g |
| tris(3-hydroxypropyl)phosphine | 1 g |
| ascorbic acid | 1 g |

The following solution (26-b) was prepared separately and added dropwise and mixed into the above solution (26-a) which had been heated at 60° C. while bubbled with nitrogen so as to prepare a silver colloidal solution. After mixing, the pH of the resulting solution was adjusted to 7 by use of KOH (26-c).

Solution (26-b):

| | |
|---|---|
| ion exchanged water | 400 g |
| silver nitrate (as silver) | 2 g |

After this solution (26-c) was left to stand for at least 24 hours, the solution was directly used as a solution (26-c') for providing a catalyst for electroless copper plating.

After an ABS resin sample subjected to pretreatments, i.e., etching and conditioning, in accordance with a conventional method was immersed in the solution (26-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 27

The following solution (27-a) was prepared. The pH of the solution was 7.

Solution (27-a)

| | |
|---|---|
| ion exchanged water | 380 g |
| potassium pyrophosphate | 200 g |
| tin sulfate (as tin) | 25 g |

The following solution (27-b) was prepared separately and added dropwise and mixed into the above solution (27-a) so as to prepare a silver colloidal solution. After mixing, the pH of the resulting solution was adjusted to 8 by use of KOH (27-c).

Solution (27-b):

| | |
|---|---|
| ion exchanged water | 400 g |
| silver nitrate (as silver) | 2 g |

This solution (27-c) was partitioned into a cathode side and an anode side by use of an anion exchange membrane. While electrolysis was being conducted by use of metallic tin as an anode so as to generate divalent tin ions continuously, the solution (27-c) was used as a solution (27-c') for providing a catalyst for electroless copper plating.

After an ABS resin sample subjected to pretreatments, i.e., etching and conditioning, in accordance with a conventional method was immersed in the solution (27-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. When plating was conducted for one week by use of the solution (27-c'), an electroless copper plated film obtained after one week was as good as an initially obtained film. Further, the resulting sample was heat-treated at 100° C. for 2 hours and then cross-cut to a width of 2 mm so as to conduct a tape peel test. As a result, peeling of the plated film was not observed.

Comparative Example 3

A silver fine particle dispersed solution was prepared in the same manner as in Example 27. This solution was directly used as a solution for providing a catalyst for electroless silver plating.

A sample was subjected to electroless silver plating under the same conditions as those in Example 27, and a tape peel test was conducted under the same conditions as those in Example 27. When divalent tin ions were not supplied, there was observed the tendency that although a good electroless copper plated film could be obtained with the solution after one week, the starting time of plating became slightly slower. Further, the resulting sample was heat-treated at 100° C. for 2 hours and then cross-cut to a width of 2 mm so as to conduct a tape peel test. As a result, peeling of the plated film was not observed.

Example 28

The following solution (28-a) was prepared.

Solution (28-a)

| | |
|---|---|
| ion exchanged water | 380 g |
| sodium citrate | 200 g |
| titanium trichloride | 20 g |

The following solution (28-b) was prepared separately and added dropwise and mixed into the above solution (28-a) so as to prepare a silver colloidal solution (28-c).

Solution (28-b):

| | |
|---|---|
| ion exchanged water | 400 g |
| silver nitrate (as silver) | 2 g |

After this solution (28-c) was left to stand for at least 24 hours, the solution was directly used as a solution (28-c') for providing a catalyst for electroless copper plating.

After an ABS resin sample subjected to pretreatments, i.e., etching and conditioning, in accordance with a conventional method was immersed in the solution (28-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 29

The following solution (29-a) was prepared.

Solution (29-a)

| | |
|---|---|
| ion exchanged water | 380 g |
| sodium citrate | 200 g |
| iron sulfate | 20 g |

The following solution (29-b) was prepared separately and added dropwise and mixed into the above solution (29-a) so as to prepare a silver colloidal solution (29-c).

Solution (29-b):

| | |
|---|---|
| ion exchanged water | 400 g |
| silver nitrate (as silver) | 2 g |

After this solution (29-c) was left to stand for at least 24 hours, the solution was directly used as a solution (29-c') for providing a catalyst for electroless copper plating.

After an ABS resin sample subjected to pretreatments, i.e., etching and conditioning, in accordance with a conventional method was immersed in the solution (29-c') for 5 minutes, the sample was rinsed with water and then immersed in the solution (1-d) containing a reducing agent for 3 minutes. After rinsed with water, the sample was immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 30

The following solution (30-a) was prepared. The pH of the solution was set at 4.

Solution (30-a)

| | |
|---|---|
| ion exchanged water | 380 g |
| sodium citrate | 200 g |
| tin methanesulfonate | 80 g |
| iron sulfate | 20 g |
| polyvinyl pyrrolidone | 500 mg/L |
| thiourea | 100 mg/L |

The following solution (30-b) was prepared separately and added dropwise and mixed into the above solution (30-a) kept at 60° C. so as to prepare a silver colloidal solution (30-c).

Solution (30-b):

| | |
|---|---|
| ion exchanged water | 400 g |
| silver methanesulfonate (as silver) | 2 g |

After this solution (30-c) was adjusted by KOH so as to have a pH of 7 and left to stand at 60° C. for at least 24 hours, the solution was directly used as a solution (30-c') for providing a catalyst for electroless copper plating.

After an ABS resin sample subjected to pretreatments, i.e., etching and conditioning, in accordance with a conventional method was immersed in the solution (30-c') for 5 minutes, the sample was rinsed with water and then immersed in the electroless copper plating solution (1-e).

After plated for 20 minutes, the sample was rinsed with water and dried. A good electroless copper plated film was obtained. The resulting sample was heat-treated at 100° C. for 2 hours and then cross-cut to a width of 2 mm so as to conduct a tape peel test. As a result, peeling of the plated film was not observed.

Example 31

As in Example 30, the solution (30-a) having a pH of 4 was prepared.

A silver colloidal solution was prepared in the same manner as in Example 30. Its pH was kept at 2.5 (31-c), and after the solution was left to stand at 60° C. for at least 24 hours, the solution was directly used as a solution (31-c') for providing a catalyst for electroless copper plating.

Electroless copper plating, a heat treatment and a tape peel test were conducted in the same manner as in Example 30. Peeling of the plated film was not observed.

Example 32

The following solution (32-a) was prepared. The pH of the solution was set at 4.

Solution (32-a)

| | |
|---|---|
| ion exchanged water | 380 g |
| sodium citrate | 200 g |
| tin methanesulfonate | 20 g |

-continued

| | |
|---|---|
| iron sulfate | 10 g |
| nickel sulfate | 1 g |
| cobalt sulfate | 1 g |
| polyvinyl pyrrolidone | 500 mg/L |
| thiourea | 100 mg/L |

The following solution (32-b) was prepared separately and added dropwise and mixed into the above solution (32-a) kept at 60° C. so as to prepare a silver colloidal solution (32-c).

Solution (32-b):

| | |
|---|---|
| ion exchanged water | 400 g |
| sodium citrate | 50 g |
| silver methanesulfonate (as silver) | 2 g |

After this solution (32-c) was adjusted by KOH so as to have a pH of 7 and left to stand at 60° C. for at least 24 hours, the solution was directly used as a solution (32-c') for providing a catalyst for electroless copper plating.

Electroless copper plating, a heat treatment and a tape peel test were conducted in the same manner as in Example 30. Peeling of the plated film was not observed. The speed of coating of the electroless copper plating was higher than that when the silver colloidal catalyst solution prepared by use of the solution (1-a).

Example 33

The following solution (33-a) was prepared. The pH of the solution was set at 4.

Solution (33-a)

| | |
|---|---|
| ion exchanged water | 380 g |
| sodium citrate | 200 g |
| tin methanesulfonate | 60 g |
| iron sulfate | 10 g |
| copper sulfate | 1 g |
| zinc sulfate | 1 g |
| monosodium dihydrogen phosphate | 10 g |
| isopropyl alcohol | 10 g |
| polyvinyl pyrrolidone | 500 mg/L |
| thiourea | 100 mg/L |
| catechol | 100 mg/L |

The following solution (33-b) was prepared separately and added dropwise and mixed into the above solution (33-a) kept at 60° C. so as to prepare a silver colloidal solution (33-c).

Solution (33-b):

| | |
|---|---|
| ion exchanged water | 400 g |
| silver methanesulfonate (as silver) | 2 g |

After this solution (33-c) was adjusted by KOH so as to have a pH of 7 and left to stand at 60° C. for at least 24 hours, the solution was directly used as a solution (33-c') for providing a catalyst for electroless copper plating.

Electroless copper plating, a heat treatment and a tape peel test were conducted in the same manner as in Example 30. Peeling of the plated film was not observed. The speed of coating of the electroless copper plating was higher than that when the silver colloidal catalyst solution prepared by use of the solution (1-a) is used.

What is claimed is:

1. A pretreatment solution for providing a catalyst for electroless plating, comprising a silver colloidal solution containing, as essential components, at least the following components (I), (II) and (III):

(I) silver colloidal particles, (II) one or more ions selected from the group consisting of an ion of a metal having an electric potential which can reduce a silver ion to metal silver in the solution and an ion oxidized at the time of reduction of the silver ion, and (III) one or more ions selected from the group consisting of a hydroxycarboxylate ion, a condensed phosphate ion and an amine carboxylate ion, the silver colloidal particles (I) being produced by the ion of the metal (II) having an electric potential which can reduce a silver ion to metal silver, wherein the silver colloid solution further contains one or more metal ions selected from the group consisting of ions of iron, cobalt, nickel, and zinc, or ions of cobalt, nickel, and zinc when the metal (II) is iron.

2. The pretreatment solution of claim 1, wherein the hydroxycarboxylate ion is provided by one or more carboxylic acids selected from the group consisting of citric acid, tartaric acid, lactic acid, malic acid, glycolic acid and gluconic acid.

3. The pretreatment solution of claim 1, wherein the condensed phosphate ion is provided by pyrophosphoric acid.

4. The pretreatment solution of claim 1, wherein the amine carboxylate ion is provided by EDTA or/and NTA.

5. The pretreatment solution of claim 1, wherein the metal having an electric potential which can reduce a silver ion to metal silver in the solution is tin, iron or titanium.

6. The pretreatment solution of claim 1, wherein the metal ion is an ion of iron.

7. The pretreatment solution of claim 1, wherein the silver colloidal solution further contains one or more ions of acids selected from the group consisting of:

(i) sulfuric acid, hydrochloric acid, nitric acid, fluoroboric acid, fluorosilicic acid, phosphoric acid, sulfamic acid, and (ii) an organic sulfonic acid.

8. The pretreatment solution of claim 7, wherein the organic sulfonic acid (ii) is one or more acids selected from the group consisting of an aliphatic sulfonic acid represented by the following general formula (A):

$$(X_1)_n—R_1—SO_3H$$

wherein $R_1$ represents an alkyl group having 1 to 5 carbon atoms, an alkenyl group having 2 to 5 carbon atoms or an alkynyl group having 2 to 5 carbon atoms; $X_1$ represents hydrogen, a hydroxyl group, an alkyl group having 1 to 5 carbon atoms, an alkoxy group having 1 to 5 carbon atoms, an aryl group, an aralkyl group, a carboxyl group or a sulfonic group and may be present at any position of $R_1$; and n is an integer of 0 to 3, or the following general formula (B):

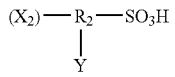

wherein $R_2$ represents an alkyl group having 1 to 5 carbon atoms or an alkylene group having 1 to 3 carbon atoms, the alkylene group may have a hydroxyl group at any position; $X_2$ represents a halogen which may substitute for one to all hydrogen atoms coordinated to the alkyl or alkylene group, and chlorine or fluorine as a substituent may be present at any position; Y represents hydrogen or a sulfonic group, and the number of substitutions of the sulfonic group represented by Y is 0 to 2, and an aromatic sulfonic acid represented by the following general formula (C):

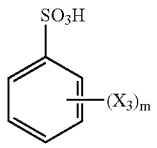

wherein $X_3$ represents a hydroxyl group, an alkyl group having 1 to 5 carbon atoms, an alkoxy group having 1 to 5 carbon atoms, an aryl group, an aralkyl group, an aldehyde group, a carboxyl group, a nitro group, a mercapto group, a sulfonic group or an amino group, and together with a benzene ring, two $X_3$s can form a naphthalene ring; and m is an integer of 0 to 3.

9. The pretreatment solution of claim 1, wherein the silver colloidal solution further contains one or more saturated aliphatic alcohols which have 10 carbon atoms or less and only a hydroxyl group as a substituent, selected from the group consisting of a linear saturated aliphatic mono-, di- or tri-alcohol represented by the following general formula (1):

$$C_nH_{2n+2-m}(X)_m$$

wherein n is an integer which is larger than m but not larger than 10; m represents an integer of 1 to 6; Xs each are hydrogen or a hydroxyl group and may be the same or different, at least one of Xs is a hydroxyl group, and Xs may be bonded to any positions of any carbon atoms; and the carbon chain may be branched, a cyclic saturated aliphatic mono-, di- or tri-alcohol represented by the following general formula (2):

$$C_nH_{2n-m}(X)_m$$

wherein n is an integer which is larger than m but not larger than 10; m represents an integer of 1 to 6; Xs each are hydrogen or a hydroxyl group and may be the same or different, at least one of Xs is a hydroxyl group, and Xs may be bonded to any positions of any carbon atoms; and the carbon chain may be branched, and a linear saturated aliphatic mono-, di- or tri-alcohol having an ether linkage represented by the following general formula (3):

$$C_nH_{2n+2-m}O_l(X)_m$$

wherein n is an integer which is larger than m but not larger than 10; m represents an integer of 1 to 4; l represents an integer of not larger than n−2; Xs each are hydrogen or a hydroxyl group and may be the same or different, at least one of Xs is a hydroxyl group, and Xs may be bonded to any positions of any carbon atoms; the carbon chain may be branched; and O represents ether oxygen and is present between any two carbon atoms.

10. The pretreatment solution of claim 9, wherein the saturated aliphatic alcohols which have 10 carbon atoms or less and only a hydroxyl group as a substituent are one or more alcohols selected from the group consisting of methanol, ethanol, n-propanol, i-propanol, n-butanol, i-butanol, t-butanol, 1-pentanol, 2-pentanol, 3-pentanol, 1,6-hexanediol, 2,5-hexanediol, 1,2-ethanediol (ethylene glycol), 1,2-propanediol (propylene glycol), 1,3-propanediol (trimethylene glycol), 1,2,3-propanetriol (glycerol) and sorbitol.

11. The pretreatment solution of claim 1, wherein the silver colloidal solution further contains a colloid dispersant.

12. The pretreatment solution of claim 1, wherein the silver colloidal solution further contains a sulfur-containing compound.

13. A pretreatment solution for providing a catalyst for electroless plating, comprising a silver colloidal solution containing, as essential components, at least the following components (I), (II) and (III):

(I) silver colloidal particles, (II) one or more ions selected from the group consisting of an ion of a metal having an electric potential which can reduce a silver ion to metal silver in the solution and an ion oxidized at the time of reduction of the silver ion, and (III) one or more ions selected from the group consisting of a hydroxycarboxylate ion, a condensed phosphate ion and an amine carboxylate ion, the silver colloidal particles (I) being produced by the ion of the metal (II) having an electric potential which can reduce a silver ion to metal silver, wherein the silver colloidal solution further contains a palladium colloid in an amount of not larger than 1/100 of the silver colloid.

14. The pretreatment solution of claim 1, wherein the silver colloidal solution further contains a pH buffer.

15. The pretreatment solution of claim 1, wherein the silver colloidal solution further contains one or more reducing compounds.

16. A pretreatment solution for providing a catalyst for electroless plating, comprising a silver colloidal solution containing, as essential components, at least the following components (I), (II) and (III):

(I) silver colloidal particles, (II) one or more ions selected from the group consisting of an ion of a metal having an electric potential which can reduce a silver ion to metal silver in the solution and an ion oxidized at the time of reduction of the silver ion, and (III) one or more ions selected from the group consisting of a hydroxycarboxylate ion, a condensed phosphate ion and an amine carboxylate ion, the silver colloidal particles (I) being produced by the ion of the metal (II) having an electric potential which can reduce a silver ion to metal silver, wherein the colloidal solution further comprises one or more reducing compounds selected from the group consisting of alkyl and phenyl phosphines.

17. The pretreatment solution of claim 16, wherein the alkyl phosphine is tris(3-hydroxypropyl)phosphine.

18. The pretreatment solution of claim 15, wherein the reducing compound is a phenolic compound or ascorbic acid.

19. The pretreatment solution of claim 1, wherein the silver colloidal solution has a pH of 3 to 11.

20. The pretreatment solution of claim 1, wherein the silver colloidal solution is prepared by adjusting the pH of a solution containing at least the components (II) and (III) and, as required, the component (IV) to 3 to 11 in advance and then mixing a solution having a silver compound dissolved therein into the solution.

21. The pretreatment solution of claim 1, wherein the silver colloidal solution is prepared by mixing a solution having a silver compound dissolved therein into a solution containing at least the components (II) and (III) and, as required, the component (IV) and then adjusting the pH of the resulting solution to 3 to 11.

22. A pretreatment solution for providing a catalyst for electroless plating, comprising a silver colloidal solution containing, as essential components, at least the following components (I), (II) and (III):

(I) silver colloidal particles, (II) one or more ions selected from the group consisting of an ion of a metal having an electric potential which can reduce a silver ion to metal silver in the solution and an ion oxidized at the time of reduction of the silver ion, and (III) one or more ions selected from the group consisting of a hydroxycarboxylate ion, a condensed phosphate ion and an amine carboxylate ion, the silver colloidal particles (I) being produced by the ion of the metal (II) having an electric potential which can reduce a silver ion to metal silver, wherein the silver colloidal solution has a pH below 3.

23. A pretreatment solution for providing a catalyst for electroless plating, comprising a silver colloidal solution containing, as essential components, at least the following components (I), (II) and (III):

(I) silver colloidal particles, (II) one or more ions selected from the group consisting of an ion of a metal having an electric potential which can reduce a silver ion to metal silver in the solution and an ion oxidized at the time of reduction of the silver ion, and (III) one or more ions selected from the group consisting of a hydroxycarboxylate ion, a condensed phosphate ion and an amine carboxylate ion, the silver colloidal particles (I) being produced by the ion of the metal (II) having an electric potential which can reduce a silver ion to metal silver, wherein the silver colloid solution further contains one or more metal ions selected from the group consisting of ions of iron, cobalt, nickel, and zinc, or ions of cobalt, nickel, and zinc when the metal (II) is iron, and wherein the silver colloidal solution is prepared by adjusting the pH of a solution containing at least the components (II) and (III) and, as required, the component (IV) to below 3 in advance and then mixing a solution having a silver component dissolved therein into the solution.

24. The pretreatment solution of claim 20, which is prepared by heating the solution to at least 50° C. at the time of addition of the solution having a silver compound dissolved therein.

25. The pretreatment solution of claim 20, which is prepared by leaving the resulting solution to stand for at least 24 hours after addition of the solution having a silver compound dissolved therein.

26. The pretreatment solution of claim 25, which is prepared by heating the resulting solution to at least 50° C. when it is left to stand for at least 24 hours.

27. The pretreatment solution of claim 20, wherein the silver colloidal solution is a solution prepared by additionally adding one or more acids or salts thereof selected from the group consisting of a hydroxycarboxylic acid, condensed phosphoric acid, an amine carboxylic acid (and salts thereof) after addition of the solution having a silver compound dissolved therein.

* * * * *